US008633865B2

(12) United States Patent
Miyagawa et al.

(10) Patent No.: US 8,633,865 B2
(45) Date of Patent: Jan. 21, 2014

(54) RADOME, ANTENNA DEVICE AND RADAR APPARATUS

(75) Inventors: Tetsuya Miyagawa, Nishinomiya (JP); Koji Yano, Nishinomiya (JP)

(73) Assignee: Furuno Electric Company Limited, Nishinomiya (JP)

( * ) Notice: Subject to any disclaimer, the term of this patent is extended or adjusted under 35 U.S.C. 154(b) by 464 days.

(21) Appl. No.: 13/016,264

(22) Filed: Jan. 28, 2011

(65) Prior Publication Data

US 2011/0248902 A1 Oct. 13, 2011

(30) Foreign Application Priority Data

Apr. 9, 2010 (JP) ..... 2010-090769

(51) Int. Cl.
*H01Q 1/42* (2006.01)

(52) U.S. Cl.
USPC ..... 343/872; 343/705

(58) Field of Classification Search
USPC ..... 343/872, 753, 757, 763, 705
See application file for complete search history.

(56) References Cited

U.S. PATENT DOCUMENTS

| | | | | |
|---|---|---|---|---|
| 4,872,019 | A | 10/1989 | Chow et al. | |
| 2003/0173460 | A1 * | 9/2003 | Chapman, Jr. | 244/123 |
| 2010/0039346 | A1 * | 2/2010 | Peter et al. | 343/872 |
| 2010/0327488 | A1 * | 12/2010 | Ay et al. | 264/312 |

FOREIGN PATENT DOCUMENTS

| | | | |
|---|---|---|---|
| JP | 9-46119 | A | 2/1997 |
| JP | 9-223924 | A | 8/1997 |
| JP | 10/200328 | A | 7/1998 |
| WO | WO 98/49746 | A1 | 11/1998 |

* cited by examiner

*Primary Examiner* — Hoanganh H Le
(74) *Attorney, Agent, or Firm* — Birch, Stewart, Kolasch & Birch, LLP

(57) ABSTRACT

This disclosure provides a radome to be installed on an emission face side of an antenna, which includes an outer wall having a side cross-section formed in a substantially semi-circular shape to include the antenna therein, and an inner wall arranged between the outer wall and the antenna, and formed in a shape to substantially conform to the outer wall. A gap between the outer wall and the inner wall is wider near both ends on the circumference of the substantially semi-circular shape than at a substantially midpoint on the circumference of the substantially semi-circular shape.

18 Claims, 7 Drawing Sheets

RADOME, ANTENNA DEVICE AND RADAR APPARATUS

CROSS-REFERENCE TO RELATED APPLICATION(S)

The application claims priority under 35 U.S.C. §119 to Japanese Patent Application No. 2010-090769, which was filed on Apr. 9, 2010, the entire disclosure of which is hereby incorporated by reference.

TECHNICAL FIELD

The present invention relates to an antenna device for transmitting and receiving an electromagnetic wave, particularly to a radome for protecting an antenna of the antenna device, and more particularly to a radar apparatus provided with the antenna device.

BACKGROUND

Typically, radar apparatuses are equipped with an antenna which emits (transmits) an electromagnetic wave at a predetermined frequency in response to supply of emission electric power and receives the electromagnetic wave from the outside, such as a reflection wave of the transmitted wave. An antenna device is constituted by the antenna and a radome having a shape to cover the antenna so that it protects the antenna from the external environment.

The radome has a wall surface also in the emitting direction of the antenna because it is a structure to protect the antenna. However, since a reflection of the electromagnetic wave occurs on the wall surface of the radome, this influence must be suppressed. For this reason, JP09-046119A and JP10-200328A disclose radomes of the antenna device, in which a wall on the emitting side of the antenna is formed in a double-wall structure to cancel out the reflections between the wall surfaces, thereby improving the emission properties.

However, the structure of the radome disclosed in JP09-046119A and JP10-200328A cannot have a wide vertical angle range where the electromagnetic wave becomes a predetermined level or more (vertical radiation pattern). Therefore, if a ship where the antenna device is installed rocks by waves, it may not be able to transmit the electromagnetic wave of an effective level, stably in a target direction.

SUMMARY

The present invention provides a radome that can have a wide vertical radiation pattern, as well as an antenna device provided with the radome, and a radar apparatus provided with the antenna device.

A radome of the present invention has an outer wall to hold the antenna emitting electromagnetic wave therein and an inner wall arranged between the outer wall and the antenna, formed in a shape to substantially conform to the outer wall. A gap between the outer wall and the inner wall is wider in circumstances than at a substantially midpoint on an emission face of the antenna.

In a radome of the present invention, in a side cross-section of the outer wall aspect to the antenna emission face may also be formed in a substantially semi-circular shape. A gap between the outer wall and the inner wall is wider near both ends on the circumference of the substantially semi-circular shape than at a substantially midpoint on the circumference of the substantially semi-circular shape. The outer wall can be formed in a tube whose side cross-section is substantially circle.

With this configuration, since the gap between the outer wall and the inner wall is wider at the ends than at the position of the substantially midpoint on the circumference of the radome (i.e., near the peak of a convex-shaped radome), the electric field of an electromagnetic wave emitted from the antenna is concentrated on a spatial area at the center of the radome by "edge effect" of the dielectric (i.e., an effect which concentrates an electric field).

Especially, by means of being formed on the outer wall and the inner wall whose gap is substantially $\lambda g/4$ of the emitted electromagnetic wave within the prescribed range of the circumference from the midpoint toward the ends, the radome can perform a low-loss electromagnetic wave emission within the range. On the contrary, within the ranges of the circumference from the prescribed positions to the ends, by means of being formed on the outer wall and the inner wall whose gaps are widened rather than the substantially $\lambda g/4$, the dielectric is efficiently formed by the outer wall and the inner wall more toward the center of the radome, as it goes near the ends. In result, the electric field of an electromagnetic wave emitted from the antenna is concentrated on a spatial area at the center of the radome with a low-loss.

In addition, an operation equivalent to the case where an opening area is substantially restricted can be produced. Therefore, the radome can radiate by a wider angle range without hardly weakening the radiation intensity, as compared with the conventional radome shape in which the gap is entirely constant and is narrowed as it goes to the ends.

The gap may be constant within a range from the substantially midpoint to a prescribed position toward both ends of the two walls and is gradually wider as approaching both the ends from the range.

The inner wall may include a first inner wall arranged so that the gap formed up to the prescribed position is constant, and second inner walls, each having a cross-section parallel to a direction toward the center of the substantially semi-circular shape from the substantially midpoint from the prescribed position.

The inner wall may include a first inner wall arranged so that the gap formed up to the prescribed position is constant, and second inner walls, each having a shape so that the gap is gradually widened toward the end from the prescribed position.

The gap may be gradually widened from the substantially midpoint to both the ends.

With this configuration, since the gap between the outer wall and the inner wall is wider at the ends than at the position of the substantially midpoint on the circumference of the radome (i.e., near the peak of a convex-shaped radome), an electromagnetic wave emitted from the antenna is easy to reflect on near the ends, and emission electric power concentrates on the central area between the radome and the antenna. In addition, an operation equivalent to the case where an opening area is substantially restricted can be produced. Therefore, the radome can radiate by a wider angle range without hardly weakening the radiation intensity, as compared with the conventional radome shape in which the gap is entirely constant and is narrowed as it goes to the ends.

According to another aspect of the invention, an antenna device is provided, which includes any of the radomes described above as a front radome, the antenna arranged so as to face an emission face thereof to the front radome, and a power supply path installed on a rear face of the antenna.

The antenna device having a wider beam width than the related arts can be implemented.

According to another aspect of the invention, a radar apparatus is provided, which includes the antenna device described above, and an electromagnetic wave generating device for generating an emission electromagnetic wave to supply electric power to the antenna device. The antenna device is installed so that an antenna rotates in a horizontal plane while emitting electromagnetic wave horizontally.

The configurations of the radome and the antenna device acts more effectively by applying the configurations of the radome and the antenna device to the apparatus for emitting the electromagnetic wave while rotating the antenna.

As described above, according to the aspects of the invention, a wider beam width than the related arts can be obtained, and even if a movable body such as a ship where the antenna device including the radome is mounted rocks, the electromagnetic wave can be transmitted and received more securely between the ship and a target area.

BRIEF DESCRIPTION OF THE DRAWINGS

The present disclosure is illustrated by way of example and not by way of limitation in the figures of the accompanying drawings, in which the like reference numerals indicate like elements and in which.

DETAILED DESCRIPTION

Several embodiments of a radome according to the present invention are described with reference to the accompanying drawings. Note that, in the following embodiments, although a case where an electromagnetic wave is emitted by an antenna device including the radome is described as an example, similar operations and effects can be obtained even when receiving an electromagnetic wave from the outside.

First Embodiment

Figure 1B:
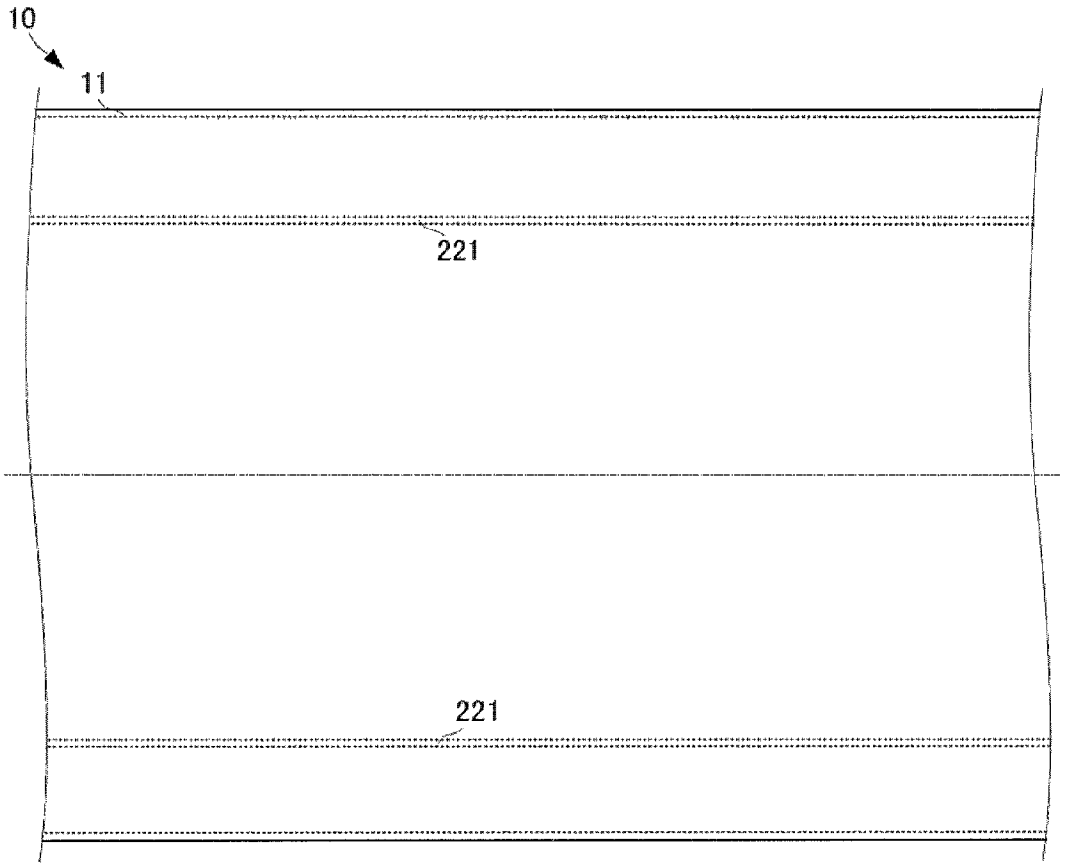
FIG. 1B is a partial elevational view of the radome.
Figure 1A:
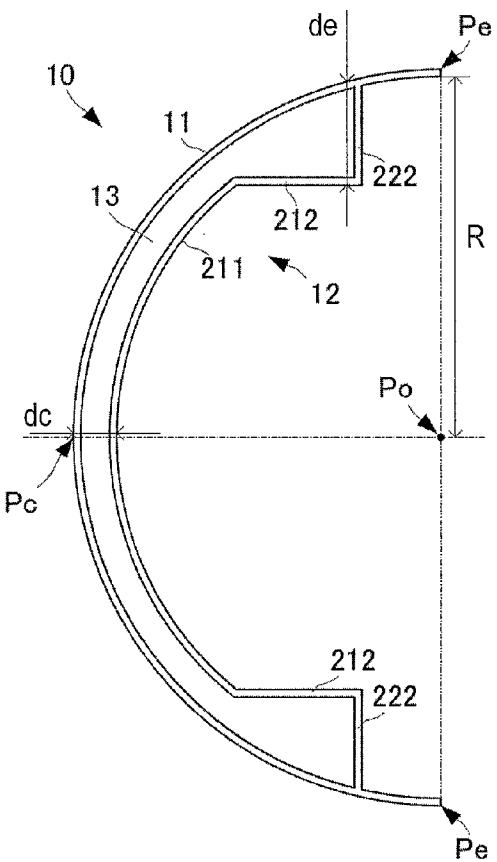
FIG. 1A is a side cross-sectional view showing a configuration of a radome according to a first embodiment of the invention.

FIG. 1A is a side cross-sectional view showing a configuration of a radome 10 according to a first embodiment of the invention, and FIG. 1B is a partial elevational view of the radome 10.

In this embodiment, the radome 10 has an elongated shape (rectangular shape) in a front view, and a semi-circular shape in a side cross-sectional view as shown in FIG. 1A. The radome 10 includes an outer wall 11 and an inner wall 12. In this embodiment, the outer wall 11 and the inner wall 12 are made of the same dielectric material. An antenna emitting an electromagnetic wave is arranged in the radome 10, and its emitting face is directed to the inner wall 12 (left direction in FIG. 1A).

The outer wall 11 constitutes an external wall surface of the radome 10, and its one side of the antenna emitting face is formed in a semi-circular shape having a predetermined thickness and a side cross-section of a radius R. A shape of an opposite side of the outer wall 11 is omitted in FIG. 1A, however, any shape can be applied. The outer wall 11 is preferably formed in a circular shape symmetry in back and forth in a side cross-sectional view, because whole of the antenna device can be downsized by reducing cross-section area.

The inner wall 12 includes a first inner wall 211 and second inner walls 212, that have substantially the same thickness as that of the outer wall 11. Note that, in this embodiment, although the first inner wall 211 and the second inner walls 212 are configured as separate members, these walls may be integrally formed, or may be joined to each other after separately formed.

The first inner wall 211 is arranged, in the side view (refer to FIG. 1A), so as to be spaced from the outer wall 11 by a certain gap dc within a range from a midpoint Pc on the circumference of the outer wall 11 to prescribed distance positions toward both ends Pe. That is, the first inner wall 211 is formed in an arc shape in the side cross-section, having a radius smaller than that of the outer wall 11.

In this embodiment, the gap dc is set to about ¼ of a wavelength λg of the emitted electromagnetic wave in a dielectric 13 that is filled between the outer wall 11 and the inner wall 12. Thereby, in this angle range, the reflection electromagnetic waves caused by the outer wall 11 and the inner wall 12 are canceled out each other to enable a low-loss emission.

On the other hand, each second inner wall 212 is formed in a flat plate shape extending along a direction which connects the midpoint Pc and the center Po of the outer wall 11, from one end thereof which is located at the end of the first inner wall 211 corresponding to the prescribed position on the circumference of the second inner wall 212, by the prescribed distance from the midpoint Pc toward the center Po.

As described above, the structure has the gap between the outer wall 11 and the inner wall 12 (the second inner wall 212) is gradually widened within the range between the prescribed positions on the circumference and the ends Pe, from the prescribed positions toward the ends Pe. In addition, near the ends Pe, gaps de between the outer wall 11 and the inner wall 12 are widened rather than the gap dc near the midpoint Pc.

The other ends of the inner wall 12 (i.e., ends opposite from the joined ends of the second inner walls 212 to the first inner wall 211) is joined to the outer wall 11 via joint walls 222, respectively. Thereby, the inner wall 211 is fixed to the outer wall 11. More specifically, each joint wall 222 is formed in a flat plate shape, which intersects perpendicularly to the direction of the second inner wall 212 and the direction connecting the midpoint Pc and the center Po of the outer wall 11.

Between the outer wall 11 and the inner wall 12, the dielectric 13 having a predetermined dielectric constant is arranged. By arranging the dielectric 13, the gap between the outer wall 11 and the inner wall 12 can be held more securely and stably.

Figure 2:
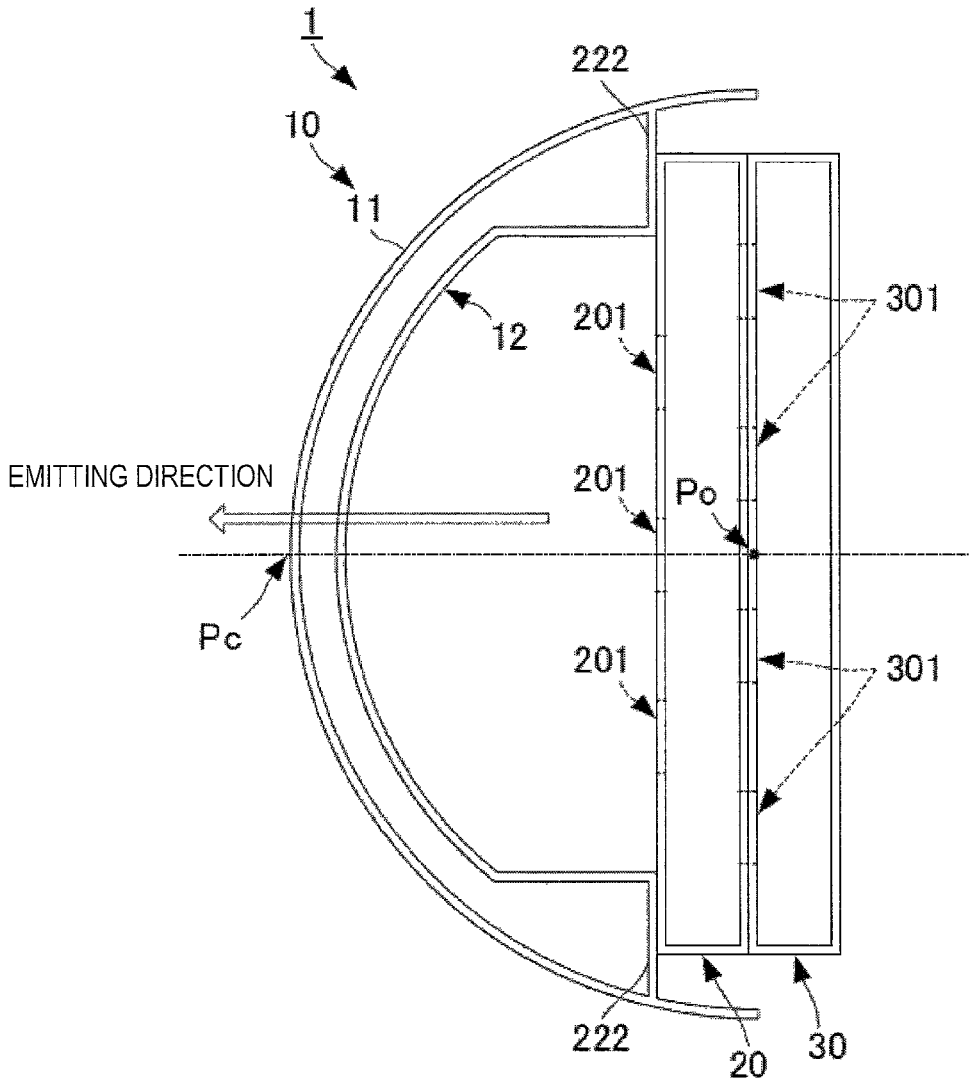
FIG. 2 is a side cross-sectional view showing a installed positional relation between the radome and an antenna.

In the radome of such a shape, an antenna 20 is arranged as shown in FIG. 2. FIG. 2 is a side cross-sectional view showing an installed positional relation between the radome 10 and the antenna 20.

The antenna 20 includes a rectangular waveguide where two or more opening slots 201 are two-dimensionally arranged in a plane view (which is a view from the right or the left in FIG. 2). The antenna 20 is arranged so that the slot opening plane of the rectangular waveguide contacts the joint walls 222 of the radome 10. Thereby, the spatial relationship of the antenna 20 and the radome 10 is fixed. A power supply waveguide 30 is arranged on the opposite side of the antenna 20 from the radome 10. The power supply waveguide 30 and the rectangular waveguide of the antenna 20 are electromagnetically coupled to each other by power supply slots 301 so that the electromagnetic wave from the power supply waveguide 30 propagates into the rectangular waveguide. The antenna 20 and the power supply waveguide 30 are arranged inside a radome of the substantially cylinder shape, which includes the radome 10 as a front radome, and a rear radome (not illustrated). Thereby, the antenna 20 and the power supply waveguide 30 are protected from the external environment.

An antenna device which protects the antenna 20 and the power supply waveguide 30 by such a radome 10 is installed on a ship so that the direction from the center Po toward Pc of the radome 10 is oriented horizontally. In this case, the antenna device is installed so that it rotates in a horizontal plane at a predetermined cycle, where the longitudinal center of the radome 10 and/or the antenna 20 is set as the rotation center.

When emitting the electromagnetic wave from the antenna device having such a configuration, the antenna 20 emits the electromagnetic wave in an emitting direction which is the direction from the center Po toward Pc of the radome 10 by the shape and the arrangement pattern of the opening slots 201 as described above.

Because the gap between the outer wall 11 and the inner wall 12 is substantially λg/4 of the emitted electromagnetic wave within the prescribed range of the circumference from the midpoint Pc toward the ends Pe, as described above, the radome 10 can perform a low-loss electromagnetic wave emission within the range (Operation A). On the other hand, within the ranges of the circumference from the prescribed positions to the ends Pe, the gaps between the outer wall 11 and the inner wall 12 (the second inner wall 212) are widened rather than the substantially λg/4 so that the dielectric is arranged more toward the center of the radome, as it goes near the ends. The dielectric has an edge effect (i.e., an effect which concentrates an electric field). Therefore, the electric field is concentrated on a spatial area at the center of the radome by the radome being the shape so that the dielectric approaches toward the center (operation B).

By such two operations (Operation A and Operation B), an opening area can be substantially narrowed to widen the emission radiation pattern, without hardly reducing the emission electric power. Note that the term "emission radiation pattern" as used herein refers to radiation pattern along the height directions of the radome 10 and the antenna 20 (vertical radiation pattern).

Figure 3:
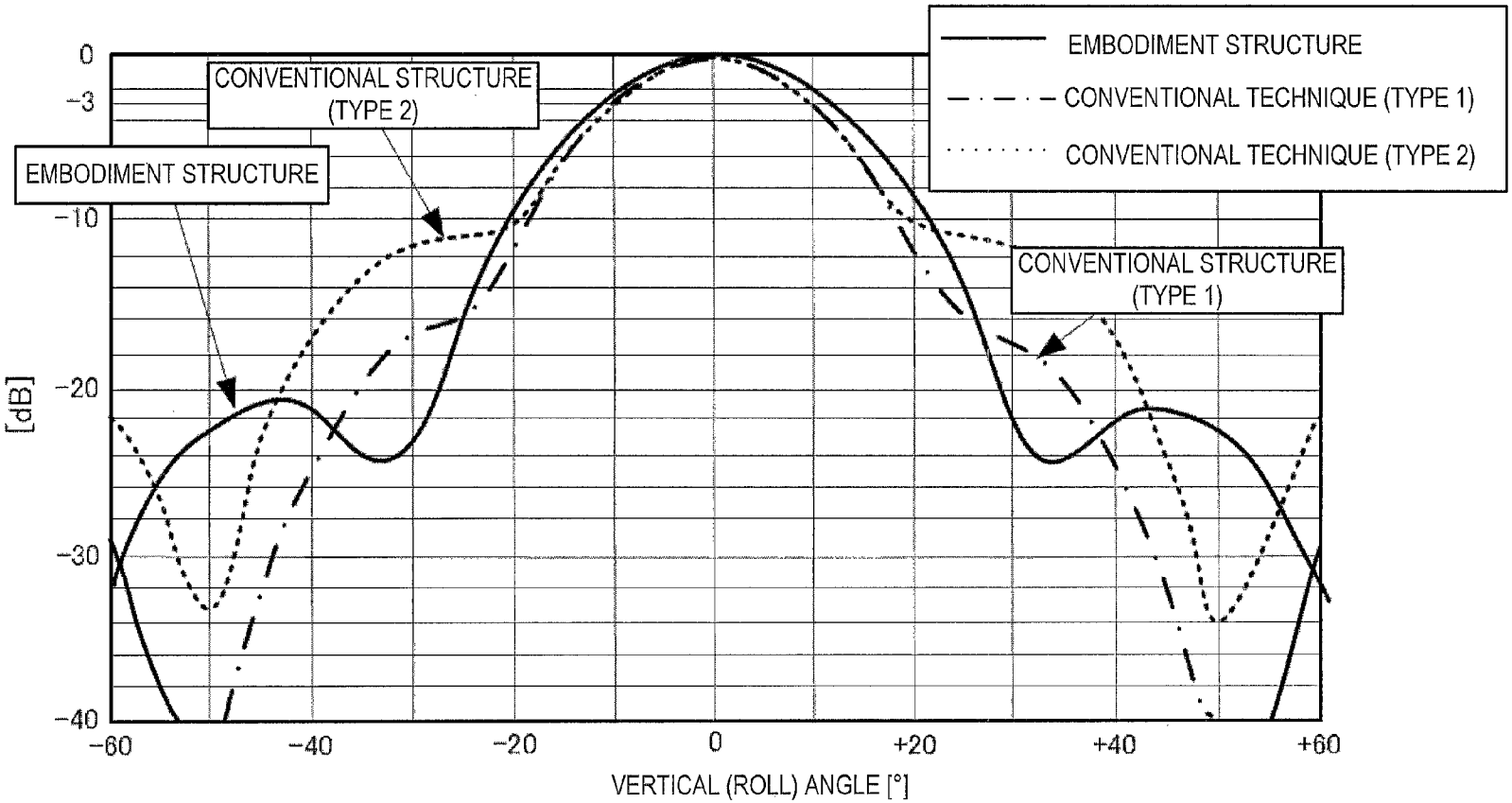
FIG. 3 is a graph showing vertical radiation pattern by the configuration of this embodiment and the conventional configuration.

FIG. 3 is a graph showing the vertical radiation pattern by the configuration of this embodiment and the conventional configuration. In FIG. 3, the Roll angle corresponds to a vertical angle where the Roll angle=0° indicates the direction connecting the center Po and the midpoint Pc of the radome 10. Moreover, in FIG. 3, Conventional Structure 1 indicates a structure in which the gap between the outer wall and the inner wall is entirely constant as disclosed in JP09-046119A, and Conventional Structure 2 indicates a structure in which the gap between the outer wall and the inner wall is gradually narrowed toward the ends from the midpoint of the outer wall as disclosed in JP10-200328A.

As shown in FIG. 3, the vertical radiation pattern is widened by using the configuration of this embodiment. More specifically, an angle range where −3 dB can be secured is about 20° (from about −10° to about +10°) by Conventional Structures 1 and 2. On the other hand, the angle range of this embodiment is widened to about 24°-26° (from about −12° or −13° to about +12° or +13°).

Thereby, even if a movable body, such as the ship in which the antenna device provided with the radome 10 of such a structure is mounted rocks, the electromagnetic wave can be emitted to a target area more securely than before. Therefore, if it is a radar apparatus which equips the antenna device, more secured target object detection will be possible.

Figure 4:
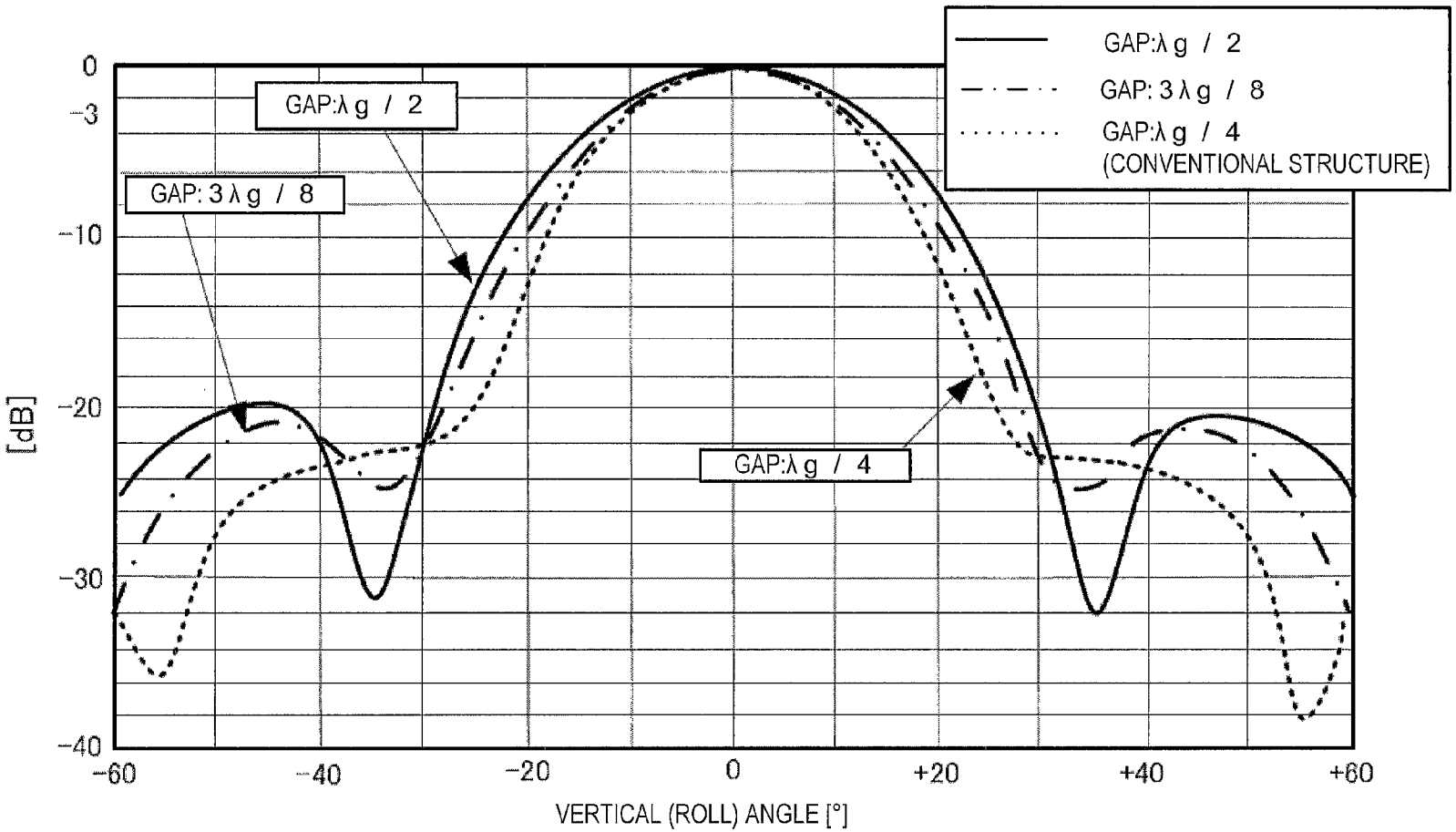
FIG. 4 is a graph showing the vertical radiation pattern when gaps near ends are different.

Although a particular value of the gaps de between the outer wall 11 and the inner wall 12 near the ends Pe is not discussed in the above description, the value is set to substantially λg/2 in this embodiment. FIG. 4 is a graph showing the vertical radiation pattern with different gaps de near the ends Pe. As shown in FIG. 4, the vertical radiation pattern is wider for the case where the gaps de are set to 3λg/8 rather than the case where the gaps de are set to λg/4 (i.e., the configuration where the gap is constant as disclosed in JP09-046119A). Furthermore, the vertical radiation pattern is wider for the case where the gaps de are set to λg/2 rather than the case where the gaps de are set to 3λg/8. That is, the vertical radiation pattern can be wider as the gaps de are widened from λg/4 to λg/2. Although the vertical radiation pattern may be possible to be further widened by widening the gaps de more than λg/2, the widening effect of the vertical radiation pattern with respect to the widening amount of the gaps de will be reduced.

In this embodiment, the vertical radiation pattern can be improved by setting the gaps de to substantially λg/2. The gaps de may be suitably set longer than λg/4 according to the vertical radiation pattern of the required specifications.

Second Embodiment

Figure 5:
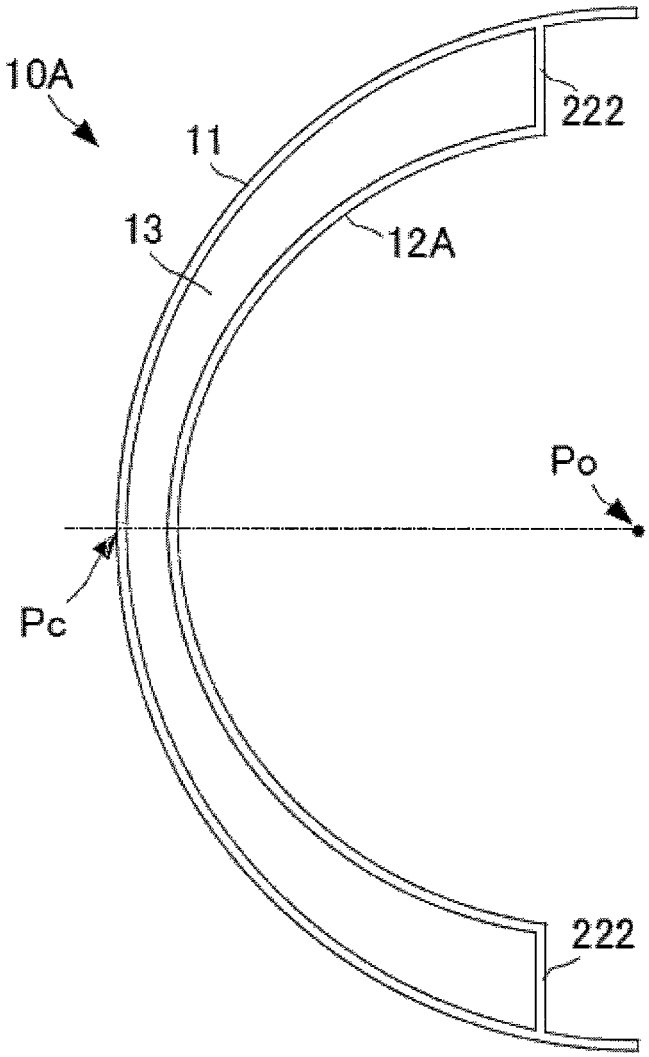
FIG. 5 is a side cross-sectional view showing a configuration of another radome according to a second embodiment of the invention.

Next, a radome 10A according to a second embodiment of the invention is described with reference to the accompanying drawings. FIG. 5 is a side cross-sectional view showing a configuration of the radome 10A. The radome 10A differs in the structure of the inner wall 12A from that of the radome 10 of the first embodiment described above.

The inner wall 12A is arranged inside the outer wall 11, and is formed so that the gap between the inner wall 12A and the outer wall 11 is gradually widened toward the ends from the midpoint Pc on the circumference of the outer wall 11. In this embodiment, at the position corresponding to the midpoint Pc of the outer wall 11, the gap between the outer wall 11 and the inner wall 12A is substantially λg/4, as described above.

More specifically, the inner wall 12A is formed so that its side cross-sectional shape is an ellipse shape, for example (i.e., it has the longest radius at a proximity position opposing to the midpoint Pc of the outer wall 11, and the radius becomes gradually shorter toward the ends). Even with such a configuration, similar operations and effects to the first embodiment can be obtained.

Third Embodiment

Figure 6:
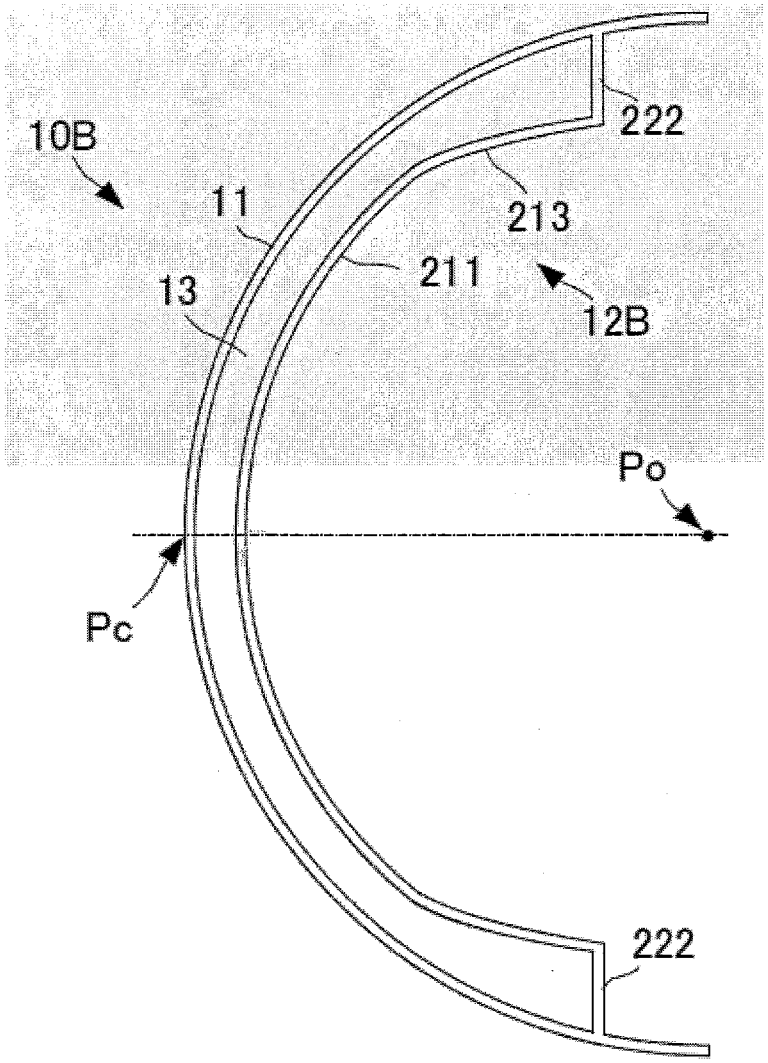
FIG. 6 is a side cross-sectional view showing a configuration of another radome according to a third embodiment of the invention.

Next, a radome 10B according to a third embodiment of the invention is described with reference to the accompanying drawings. FIG. 6 is a side cross-sectional view showing a configuration of the radome 10B according to this embodiment. The radome 10B differs in the structure of the inner wall 12B from that of the radome 10 of the first embodiment described above.

The inner wall 12B includes the first inner wall 211 that has the same shape as the first embodiment and is spaced by λg/4 from the outer wall 11, and a third inner wall 213 coupled to the first inner wall 211. The third inner wall 213 differs from the second inner wall 212 of the first embodiment, and has an arc shape extending from one end of the first inner wall 211. Here, the arc shape is set so that a gap between the outer wall 11 and the third inner wall 213 is widened gradually toward the ends from a prescribed position. Even with such a configuration, similar operations and effects as the first embodiment can be obtained.

The above embodiments are merely a group of examples which achieves the present invention, and based on these, a configuration in which the gap between the outer wall 11 and the inner wall 12 near the ends Pe becomes wider than the center Pc of the outer wall 11 may also be used. That is, for example, that gap may be formed by different ellipses of different radii of curvature for ranges from the center Pc to the prescribed positions and ranges from the prescribed positions to the ends.

Moreover, in the above embodiments, the case where the outer wall 11 having the semi-circular side cross-section is used. However, the above embodiments may also adopt other structures such as a distorted semi-circular shape (substantially semi-circular shape) as long as the gap between the outer wall and the inner wall can have the relation described above.

Figure 7:
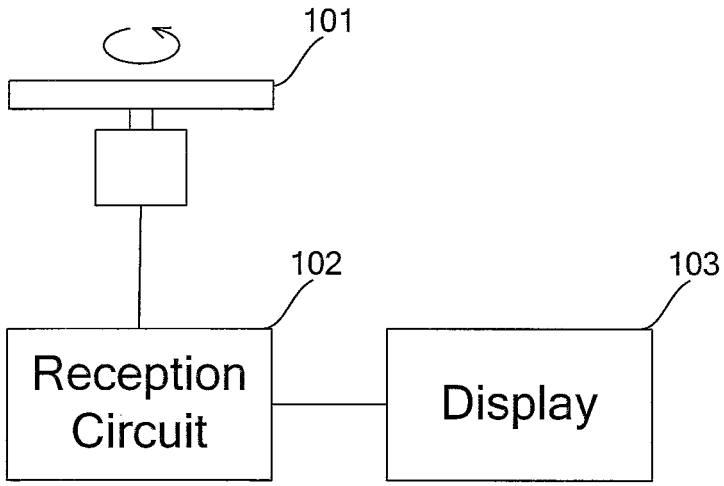
FIG. 7 is a block-diagram of a radar apparatus according to the present invention.

Moreover, in the above description, the antenna device used for the ship radar is described, it may also be used for other movable bodies which may rock. FIG. 7 shows a block-diagram of a radar apparatus of the present invention, as an example applied to the ship radar.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

What is claimed is:

1. A radome comprising:

an outer wall to hold an antenna emitting electromagnetic wave therein; and an inner wall arranged between the outer wall and the antenna, and formed in a shape to substantially conform to the outer wall;

wherein a gap between the outer wall and the inner wall is wider at other positions than at a substantially midpoint on an emission face of the antenna, wherein the gap is constant within a range from the substantially midpoint to prescribed positions toward both ends of the two walls, respectively, and is gradually wider as approaching both the ends from the range.

2. The radome of claim 1, wherein a side cross-section of the outer wall aspect to the antenna emission face is formed in a substantially semi-circular shape; and a gap between the outer wall and the inner wall is wider near both ends on the circumference of the substantially semi-circular shape than at a substantially midpoint on the circumference of the substantially semi-circular shape.

3. The radome of claim 2, wherein the gap is substantially λg/4 of the emitted electromagnetic wave within the prescribed range of the circumference from the midpoint toward the ends.

4. The radome of claim 3, wherein within the ranges of the circumference from the prescribed positions to the ends, the gaps between the outer wall and the inner wall are widened rather than the substantially λg/4 of the emitted electromagnetic wave.

5. The radome of claim 2, wherein the inner wall includes:

a first inner wall arranged so that the gap formed up to the prescribed position is constant; and second inner walls, each having a cross-section projecting from the inner wall parallel to a direction toward the center of the substantially semi-circular shape from the substantially midpoint.

6. The radome of claim 2, wherein the inner wall includes:

a first inner wall arranged so that the gap formed up to the prescribed position is constant; and second inner walls, each having a shape so that the gap is gradually widened toward the end from the prescribed position as one end.

7. An antenna device, comprising:

the radome of claim 2;

the antenna arranged so as to face the emission face thereof to the inner wall; and a power supply path installed on a rear face of the antenna.

8. The radome of claim 2, further comprising:

joint walls which join respective ends of the inner wall to the outer wall, wherein each joint wall has a cross-section parallel to a direction from the ends of the outer wall to a center of the substantially circular shape.

9. The radome of claim 1, wherein the outer wall is formed in a tube whose side cross-section is substantially circle.

10. The radome of claim 9, wherein the gap is substantially λg/4 of the emitted electromagnetic wave within the prescribed range of the circumference from the midpoint toward the ends.

11. The radome of claim 10, wherein within the ranges of the circumference from the prescribed positions to the ends, the gaps between the outer wall and the inner wall are widened rather than the substantially λg/4 of the emitted electromagnetic wave.

12. An antenna device, comprising:

the radome of claim 10;

the antenna arranged so as to face the emission face thereof to the inner wall; and a power supply path installed on a rear face of the antenna.

13. A radar apparatus, comprising:

the antenna device of claim 12; and a receiving signal circuit for receiving echo signals from targets, wherein the antenna device rotates in a horizontal plane while emitting electromagnetic wave horizontally.

14. The radome of claim 1, wherein a side cross-section of the outer wall aspect to the antenna emission face is formed in a substantially semi-circular shape; and the inner wall includes:

a first inner wall arranged so that the gap formed up to the prescribed position is constant; and second inner walls, each having a cross-section projecting from the inner wall parallel to a direction toward the center of the substantially semi-circular shape from the substantially midpoint.

15. The radome of claim 1, wherein the inner wall includes:

a first inner wall arranged so that the gap formed up to the prescribed positions from the substantially midpoint is constant; and second inner walls, each having a shape so that the gap is gradually widened toward the end from a corresponding one of the prescribed positions as one end.

16. An antenna device, comprising:

the radome of claim 1;

the antenna arranged so as to face the emission face thereof to the inner wall; and a power supply path installed on a rear face of the antenna.

17. A radar apparatus, comprising:

the antenna device of claim 16; and a receiving signal circuit for receiving echo signals from targets, wherein the antenna device rotates in a horizontal plane while emitting electromagnetic wave horizontally.

18. The radome of claim 1, further comprising:

joint which join respective ends of the inner wall to the outer wall.

* * * * *